US009289772B2

(12) United States Patent
Storm et al.

(10) Patent No.: US 9,289,772 B2
(45) Date of Patent: Mar. 22, 2016

(54) SYSTEM FOR IMPROVING AIRFLOW CHARACTERISTICS WITHIN A COAL PULVERIZER

(71) Applicant: Storm Technologies Inc., Albemarle, NC (US)

(72) Inventors: Richard F. Storm, Albemarle, NC (US); Danny S. Storm, Norwood, NC (US); Adam C. McClellan, Stanfield, NC (US)

(73) Assignee: Storm Technologies, Inc., Albemarle, NC (US)

( * ) Notice: Subject to any disclaimer, the term of this patent is extended or adjusted under 35 U.S.C. 154(b) by 433 days.

(21) Appl. No.: 13/957,207

(22) Filed: Aug. 1, 2013

(65) Prior Publication Data

US 2015/0034746 A1 Feb. 5, 2015

(51) Int. Cl.
*B02C 15/00* (2006.01)

(52) U.S. Cl.
CPC ..... *B02C 15/001* (2013.01); *B02C 15/003* (2013.01)

(58) Field of Classification Search
CPC ..... B02C 15/001; B02C 15/003
USPC ..... 241/117–121
See application file for complete search history.

(56) References Cited

U.S. PATENT DOCUMENTS 4,234,132 A * 11/1980 Maliszewski, Jr. ... B02C 15/001 241/119
4,754,932 A * 7/1988 Kmiotek ..... B02C 15/00 241/101.3
4,907,751 A * 3/1990 Wark ..... B02C 15/007 241/119
5,971,302 A 10/1999 Doumet
7,100,853 B2 * 9/2006 Wark ..... B02C 15/001 241/119
7,267,293 B2 * 9/2007 Chen ..... B02C 15/001 241/117
7,448,565 B2 * 11/2008 Farris ..... B02C 15/001 209/139.1
8,317,119 B2 * 11/2012 Wark ..... B02C 15/001 241/119
8,336,796 B2 * 12/2012 Wark ..... B02C 15/001 241/119
RE44,772 E * 2/2014 Wark ..... B02C 15/04 241/119
2006/0022075 A1 * 2/2006 Wark ..... B02C 15/001 241/119
2011/0114768 A1 5/2011 Horning
2011/0114769 A1 * 5/2011 Wark ..... B02C 15/001 241/119
2011/0127360 A1 6/2011 Horning
2011/0168819 A1 * 7/2011 Wark ..... B02C 15/04 241/119
2012/0085849 A1 * 4/2012 Knope ..... B02C 15/001 241/101.2

FOREIGN PATENT DOCUMENTS

JP 09047679 A 2/1997
JP 2002059017 A 2/2002
JP 2002273251 A 9/2002
JP 2002370044 A 12/2002
JP 2008149281 A 7/2008
JP 2011177690 A 9/2011
JP 2011242006 A 12/2011

* cited by examiner

*Primary Examiner* — Faye Francis
(74) *Attorney, Agent, or Firm* — McNair Law Firm, P.A.; Seann P. Lahey

(57) ABSTRACT

A coal pulverizer including a mill housing, a grinding surface disposed in said mill housing, a grinding wheel engaging said grinding surface for pulverizing coal chunks; an annular throat disposed around said grinding surface channeling a primary airflow from a lower housing portion below said grinding surface upward through an upper housing portion above said grinding surface; an annular secondary airflow chamber extending around an exterior of said upper housing portion channeling a secondary airflow circumferentially into said upper housing portion above said grinding surface; and, an annular secondary airflow deflector extending along an interior of said upper housing portion above said grinding surface directing said secondary airflow from said secondary airflow chamber downward across said grinding surface in a generally uniform uninterrupted circumferential airflow pattern.

19 Claims, 3 Drawing Sheets

SYSTEM FOR IMPROVING AIRFLOW CHARACTERISTICS WITHIN A COAL PULVERIZER

BACKGROUND OF THE INVENTION

1) Field of the Invention

The present invention relates to airflow improvements in coal pulverizers, and more particularly, to a system for improving performance on a vertical spindle coal pulverizer by providing a secondary airflow path introduced above the grinding surface that is directed downward for sweeping across the grinding zone.

2) Description of Related Art

Pulverized coal fired power plants produce electricity and/or steam for industrial use through the use of a boiler which converts water to steam that is then either utilized for industrial use or to power a turbine which powers an electric generator. Raw coal is feed to the pulverizer in chunks which are then ground within the pulverizer, dried and transported with air to the burners connected to the boiler. Pulverizer performance is critical to the performance of the boiler.

One specific type of pulverizer is known as a Vertical Spindle Coal Pulverizer. These types of pulverizers operate by having the raw coal chunks feed onto a rotating grinding surface. The coal is then forced between grinding elements, typically large journals/tires. A primary airflow is feed upward through the pulverizer from a lower housing portion around the grinding surface, which acts as the transport for the coal "fines" or pulverized particles of coal to move upward to the classifier. This primary airflow also dries the coal. The area around the rotating grinding table is referred to as the pulverizer throat. Raw coal also has pyrites which are rejected or allowed to pass through the pulverizer throat and exit the pulverizer under the grinding surface. In order to achieve desired pulverizer and burner performance the ratio of fuel/coal to air is critical and must be measured and controlled.

Pulverizer performance includes but is not limited to the particle size distribution, air/fuel ratio, air and fuel distribution leaving the pulverizer, amount of coal being rejected out of the bottom of the pulverizer and drying ability of the mill in order to maintain controllable pulverizer outlet temperatures. A major factor in performance that impacts all of the above is how the air enters the pulverizer at the pulverizer throat located around and generally below the grinding surface. High pulverizer differential pressure between a lower housing and upper housing is a common issue which can limit primary airflow capacity and thus pulverizer throughput/capacity. Mill rumble due to a bed of coal fines building up on the table and causing the journals/tires to skid is also a common issue resulting from airflow limitations. Also, coals with high levels of silica can result in the accumulation of sand beds which are high density and difficult if not impossible to remove with current throat configuration and high differential pressures.

Airflow of approximately 7,000 fpm velocities (terminal velocity of raw coal) must be maintained in order to prevent coal from being rejected through the pulverizer throat while still allowing larger pyrites to be rejected through the throat. A problem with most typical pulverizer throats is that they are not sized properly and thus do not reach the necessary airflow velocity at low load/coal throughput. Attempts to correct this type of problem result in larger amounts of airflow being introduced into the pulverizer, which result in increased differential pressures and high air to fuel ratios that adversely affect pulverizer and burner performance (poor fineness, poor distribution out of the pulverizer, higher than desired velocities at the burner impacting combustion).

Further, if coal is allowed to spill to the lower housing portion or underbowl, which is the same area in which the primary air enters, it gets heated to the primary air temperature and if it is not removed can result in mill fires. Accordingly, a need has arisen in maintaining a proper airflow and reducing differential pressures in the pulverizer to move coal fines upward through the pulverizer to the burners will allowing other materials to pass downward through the throat.

Accordingly, it is an object of the present invention to provide a secondary airflow into the mill housing from above the grinding surface bypassing the pulverizer throat to improve airflow dynamic and pulverizer efficiency.

It is another object of the invention to maintain lower pulverizer differential pressure by introducing a secondary airflow into the mill housing above the pulverizer throat and grinding surface.

It is another object of the invention to reduce low load mill rumble by clearing fine particles from the grinding zone by directing a secondary airflow entering the upper housing downward across the grinding surface.

It is another object of the invention to control a secondary airflow into the upper housing of the mill above the grinding surface to adjust air/fuel ratios according to load.

It is another object of the invention to improve pulverizer performance by providing primary classification at the grinding zone by efficiently removing the coal fines and allowing non-coal materials to be rejected through the throat.

SUMMARY OF THE INVENTION

The above objectives are accomplished according to the present invention by providing a coal pulverizer comprising a mill housing; a grinding surface disposed in said mill housing; a grinding wheel engaging said grinding surface for pulverizing coal chunks; an annular throat disposed around said grinding surface channeling a primary airflow from a lower housing portion below said grinding surface upward through an upper housing portion above said grinding surface; an annular secondary airflow chamber extending around an exterior of said upper housing portion channeling a secondary airflow circumferentially into said upper housing portion above said grinding surface; and, an annular secondary airflow deflector extending along an interior of said upper housing portion above said grinding surface directing said secondary airflow from said secondary airflow chamber downward across said grinding surface in a generally uniform uninterrupted circumferential airflow pattern.

In a further advantageous embodiment, a housing port is disposed in said upper housing portion in fluid communication with said secondary airflow chamber for passing air into said housing above said grinding surface.

In a further advantageous embodiment, said secondary airflow deflector includes an annular upper plate extending along said interior of said upper housing portion generally adjacent to and above said housing port.

In a further advantageous embodiment, said secondary airflow deflector includes an annular lower plate extending along said interior of said upper housing portion generally adjacent to and below said housing port.

In a further advantageous embodiment, said upper plate and lower plate are angled downward toward said grinding surface directing said secondary airflow across said grinding surface.

In a further advantageous embodiment, a lateral spacing of said upper plate and lower plate on opposing sides of said housing port defines an annular deflector channel in fluid communication with said secondary airflow chamber channeling said secondary airflow downward across said grinding surface.

In a further advantageous embodiment, a series of support walls are disposed in said deflector channel interconnecting said upper plate and said lower plate to maintain spacing between said upper and lower plates.

In a further advantageous embodiment, an annular primary airflow deflector is disposed in said mill housing generally adjacent to and extending around said annular throat.

In a further advantageous embodiment, said primary airflow deflector is angled inward over said annular throat toward said grinding surface for directing said primary airflow from said lower housing portion toward said grinding surface.

In a further advantageous embodiment, a distal edge of said primary airflow deflector is connected to a distal edge of said secondary airflow deflector so there are no gaps between said primary airflow deflector and said secondary airflow deflector.

In a further advantageous embodiment, a bypass conduit is provided channeling a portion of said primary airflow into said secondary airflow chamber for providing said secondary airflow.

In a further advantageous embodiment, an airflow valve is operatively associated with said bypass conduit for controlling the flow of air through said bypass conduit to alter differential pressures between said upper housing portion and said lower housing portion and maintain desired air/fuel ratios.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention. Likewise, other objects, features, benefits and advantages of the present invention will be apparent from this summary and certain embodiments described below. Such objects, features, benefits and advantages will be apparent from the above in conjunction with the accompanying examples and figures and all reasonable inferences to be drawn therefrom.

DETAILED DESCRIPTION OF A PREFERRED EMBODIMENT

With reference to the drawings, the invention will now be described in more detail.

Figure 1:
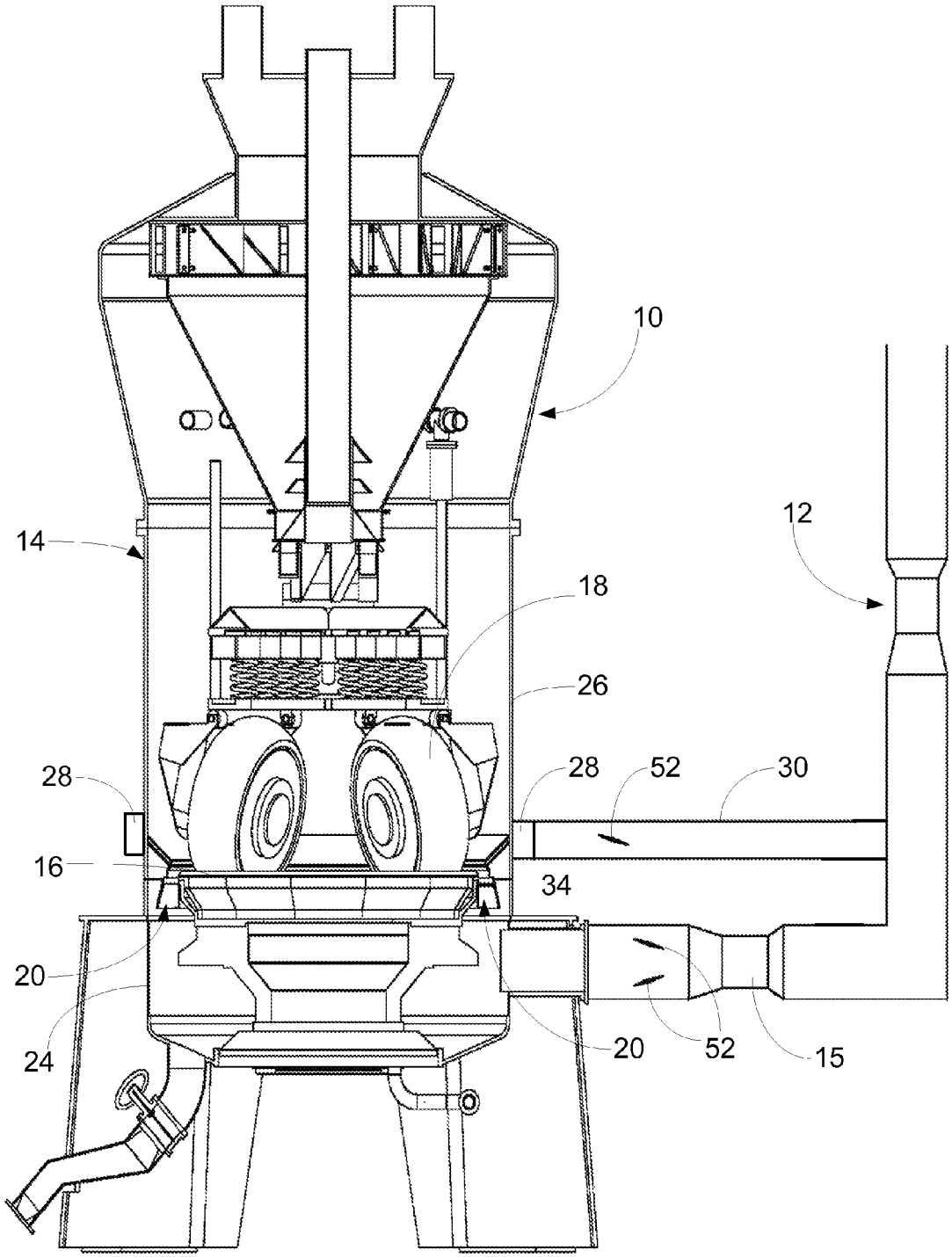
FIG. 1 shows a cut-away side view of a vertical spindle coal pulverizer having a secondary airflow path according to the present invention.

Referring to FIG. 1, a vertical spindle coal pulverizer, designated generally as 10, is shown operatively connected to an air handler, designated generally as 12, for providing air into the pulverizer 10. The mill includes a housing, designated generally as 14, with a grinding surface 16 disposed in the mill housing 14. A grinding wheel 18 is carried in housing 14 and engages grinding surface 16 for pulverizing coal chunks that are dropped on the grinding surface.

Figure 2:
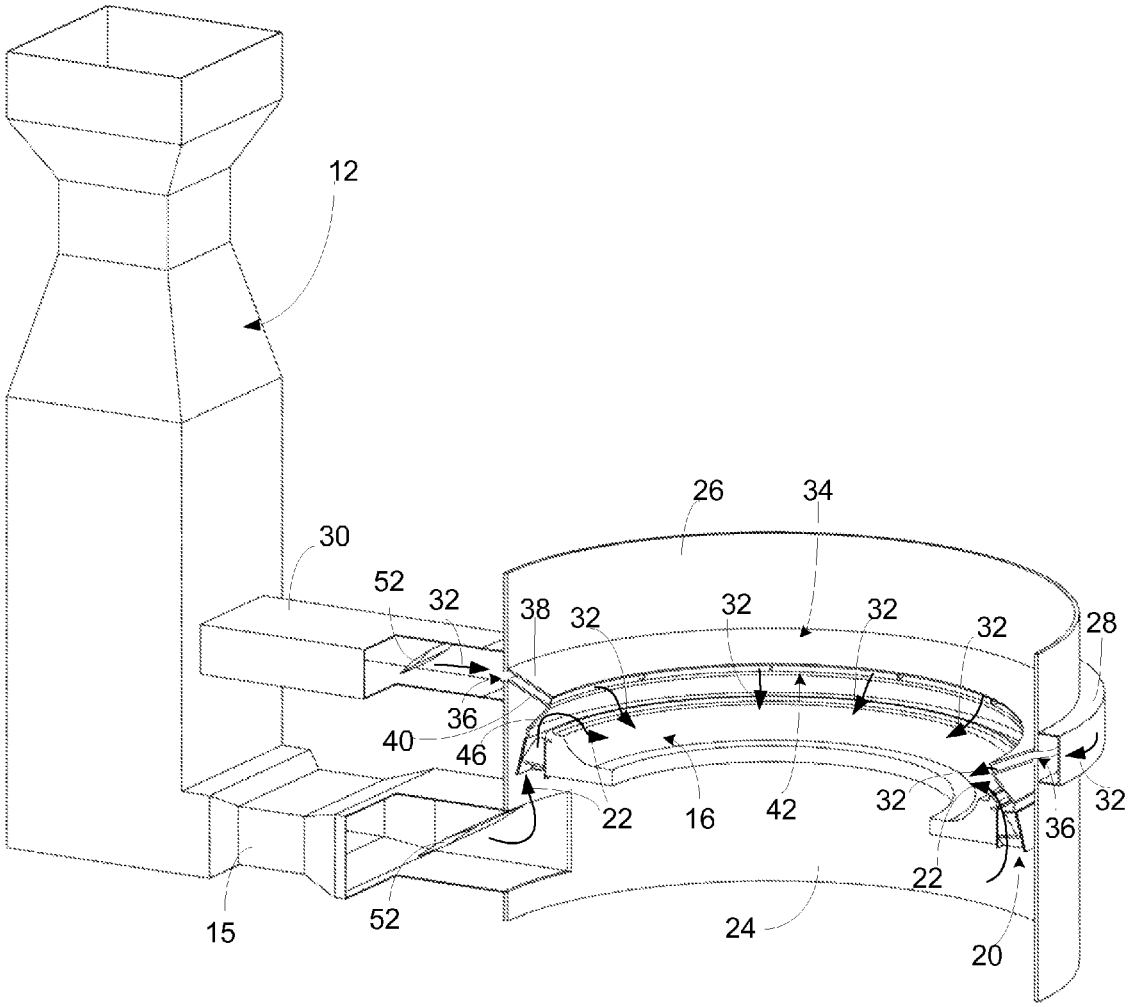
FIG. 2 shows a cut-away view of a portion of the vertical spindle coal pulverizer housing the airflow deflectors and grinding surface according to the present invention; and, FIG. 3 shows a detailed cross section view of the secondary airflow chamber and airflow deflectors of the vertical spindle coal pulverizer according to the present invention.

With further reference to FIG. 2, a primary airflow, designated by flow arrows 22, is provided into housing 14 from air handler 12 by way of primary conduit 15. More particularly, housing 14 includes a lower housing portion 24 disposed below grinding surface 16 that first receives primary airflow 22. An annular throat 20 extends around grinding surface 16. Annular throat 20 channels primary airflow 22 upward from lower housing portion 24 and into an upper housing portion 26 above grinding surface 16 for lifting the pulverized coal through the rest of the system.

Figure 3:
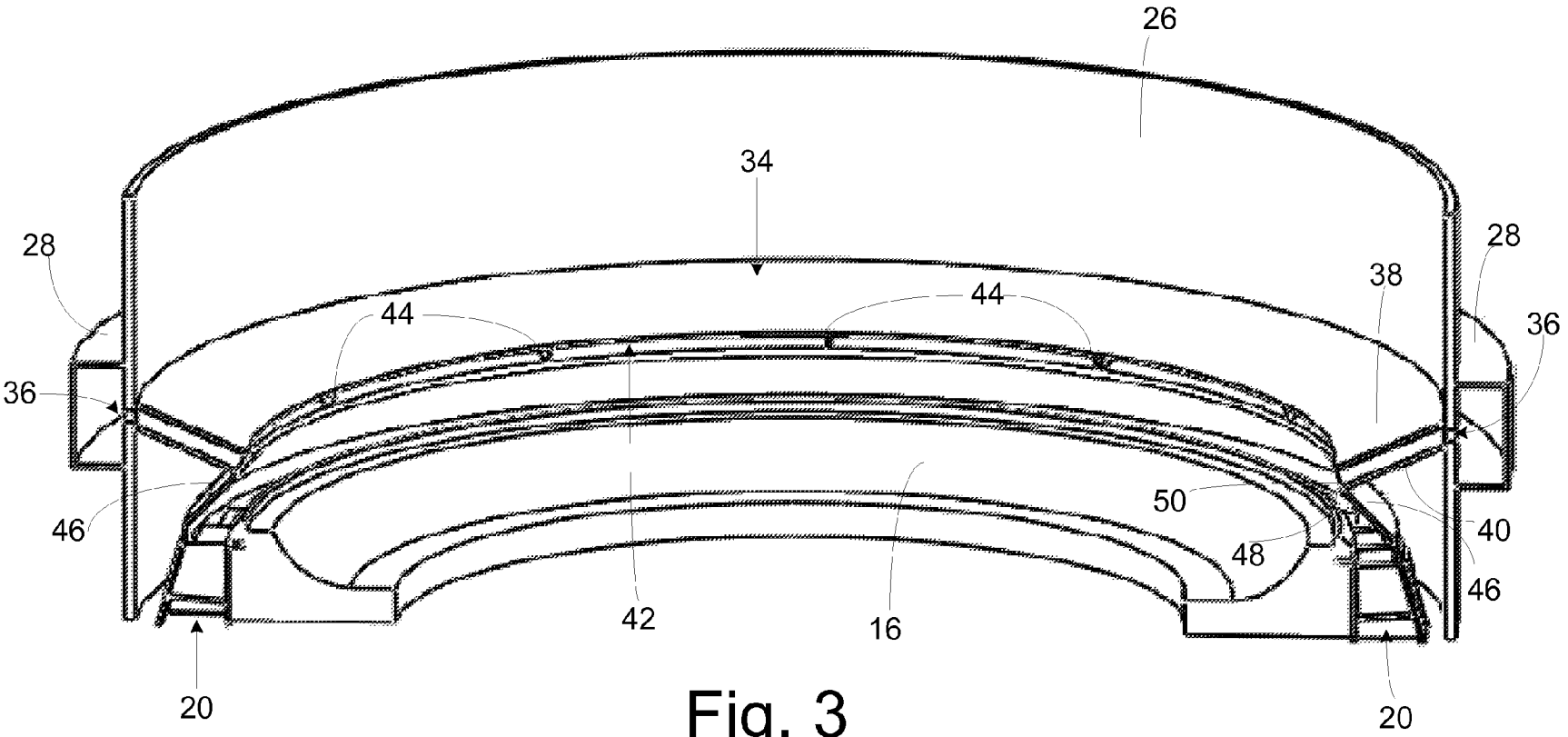

Referring to FIGS. 1-3, to introduce a secondary airflow pattern into upper housing portion 26 above grinding surface 16, a secondary airflow chamber 28 is provided on housing 14 which is operatively associated with air handler 12 by way of bypass conduit 30 for channeling a portion of the primary airflow into secondary airflow chamber 28. Secondary airflow chamber 28 extends annularly around an exterior of upper housing portion 26 and channels a secondary airflow, designated by flow arrows 32, circumferentially around and into upper housing portion 26 above grinding surface 16. Accordingly, secondary airflow 32 is generally uniformly distributed in a circular pattern into upper housing portion 26.

A secondary airflow deflector, designated generally as 34, is carried in upper housing portion 26 in an annular arrangement that extends along and around the entire interior side of upper housing portion 26 above grinding surface 16. Secondary airflow deflector 34 is angled to direct secondary airflow 32 from secondary airflow chamber 28 downward across grinding surface 16 in a generally uniform uninterrupted circumferential airflow pattern.

Referring to FIGS. 2 and 3, a housing port 36 is disposed in upper housing portion 26 in fluid communication with secondary airflow chamber 28 for passing air from secondary airflow chamber 28 into upper housing portion 26 above grinding surface 16. Housing port 36 can be a single annular extending slot in upper housing portion 26, or a series of smaller slots or holes that are generally uniformly spaced circumferentially around upper housing portion 26 for a generally uniformly distributed circular airflow pattern into upper housing portion 26 for engaging secondary airflow deflector 34.

Referring to FIG. 3, in the illustrated embodiment, secondary airflow deflector 34 includes an annular upper plate 38 extending along the interior of upper housing portion 26 generally adjacent to and above housing port 36. Further, secondary airflow deflector 34 includes an annular lower plate 40 extending along interior of upper housing portion 26 generally adjacent to and below housing port 36. A lateral spacing of upper plate 38 and lower plate 40 on opposing sides of housing port 36 defines an annular deflector channel 42 in fluid communication with secondary airflow chamber 28. Upper plate 38 and lower plate 40 are preferably angled downward toward grinding surface 16. In the illustrated embodiment, a series of support walls 44 are disposed in deflector channel 42 interconnecting upper plate 38 and lower plate 40 to maintain spacing between upper and lower plates 38 and 40 and structurally reinforce secondary airflow deflector 34. Accordingly, secondary airflow 32 exits secondary airflow chamber 28 through housing port(s) 36 and is received into annular deflector channel 42 between upper plate 38 and lower plate 40 of secondary airflow deflector 34, which directs secondary airflow 32 downward across grinding surface 16 in a circular arrangement.

Referring to FIGS. 2 and 3, in a preferred embodiment, an annular primary airflow deflector 46 is disposed in mill housing 14 generally adjacent to and extending around annular throat 20. In the illustrated embodiment, primary airflow deflector 46 is angled inward over annular throat 20 toward grinding surface 16 for directing primary airflow 22 from lower housing portion 24 toward grinding surface 16. Preferably, a distal edge 48 of primary airflow deflector 46 is connected to a distal edge 50 of secondary airflow deflector 34 so there are no gaps between said primary airflow deflector and said secondary airflow deflector to disrupt airflow patterns and trap coal particles.

Referring to FIGS. 1 and 2, in the illustrated embodiment, an airflow valve 52 is disposed within each of primary conduit 15 and bypass conduit 30 for controlling the flow of air from air handler 12 into housing 14. The airflow valves 52 can be independently operated to adjust airflows in the respective conduit and alter differential pressures between upper housing portion 26 and lower housing portion 24 to maintain desired air/fuel ratios.

Accordingly, the present invention provides an improved design particularly for retrofitting existing vertical spindle pulverizer throats such that the airflow characteristics and pulverizer performance are improved. Secondary airflow is provided in the illustrated embodiment by a single secondary airflow chamber annularly arranged on housing 14, but alternatively can be provided by a series of separate bypass conduits directly engaging housing 14 at various points around the perimeter. A rotating throat 20 is preferably utilized to assure there are no quiescent zones in which coal could settle and to improve mixing. The pulverizers annular throat 20 is sized such that adequate velocity is maintained to keep coal in suspension (7,000 fpm) while allowing larger pyrites to be rejected to the lower housing portion 24. The secondary airflow is directed toward the grinding table such that primary classification takes place as well as assisting with mill rumble.

Unlike most traditional designs, the present invention splits the primary air into two flow streams. By splitting the stream, the pulverizer throat annulus 20 can be sized to maintain 7,000 fpm at all times, keeping the coal in suspension while not allowing coal rejects. The second airflow stream enters above the pulverizer throat. This can be sized such that lower mill differential pressures are achieved.

By directing the secondary airflow at the bed of coal on grinding surface 16, mill rumble can be alleviated by removing the fine particles of coal or removing the sand bed. By having two airflow streams and directing the air towards the coal bed, improved mixing of the coal and air is achieved improving drying capacity. Further, by maintaining a constant 7,000 fpm in the pulverizer throat annulus (rather than ramping up velocities with coal feed rate) wear is greatly reduced. With this design it is still possible to achieve primary classification as with current pulverizer/deflector designs.

Mill fires in the lower housing portion 24 are a common problem and can result in lots of damage if they occur. This design helps prevent fires by minimizing the coal rejects to the lower housing portion 24. However if coal does reach the lower housing portion 24 this design further prevent fires by the fact that less mass flow of primary air will enter through the lower housing portion 24. Also it is possible to utilize cooler air through the pulverizer throat 20 and utilize the bypass air to control mill outlet temperature. This lowers the temperature of the lower housing portion 24 and reduce the risk of fires.

While a preferred embodiment of the invention has been described using specific terms, such description is for illustrative purposes only, and it is to be understood that changes and variations may be made without departing from the spirit or scope of the following claims.

What is claimed is:

1. A coal pulverizer comprising:

a mill housing;

a grinding surface disposed in said mill housing;

a grinding wheel engaging said grinding surface for pulverizing coal chunks;

an annular throat disposed around said grinding surface channeling a primary airflow from a lower housing portion below said grinding surface upward through an upper housing portion above said grinding surface;

an annular secondary airflow chamber extending around an exterior of said upper housing portion channeling a secondary airflow circumferentially into said upper housing portion above said grinding surface; and, an annular secondary airflow deflector extending along an interior of said upper housing portion above said grinding surface directing said secondary airflow from said secondary airflow chamber downward across said grinding surface in a uniform uninterrupted circumferential airflow pattern.

2. The pulverizer of claim 1 including a housing port disposed in said upper housing portion in fluid communication with said secondary airflow chamber for passing air into said housing above said grinding surface.

3. The pulverizer of claim 2 wherein said secondary airflow deflector includes an annular upper plate extending along said interior of said upper housing portion adjacent to and above said housing port.

4. The pulverizer of claim 3 wherein said secondary airflow deflector includes an annular lower plate extending along said interior of said upper housing portion adjacent to and below said housing port.

5. The pulverizer of claim 4 wherein said upper plate and lower plate are angled downward toward said grinding surface directing said secondary airflow across said grinding surface.

6. The pulverizer of claim 5 wherein a lateral spacing of said upper plate and lower plate on opposing sides of said housing port defines an annular deflector channel in fluid communication with said secondary airflow chamber channeling said secondary airflow downward across said grinding surface.

7. The pulverizer of claim 6 including a series of support walls disposed in said deflector channel interconnecting said upper plate and said lower plate to maintain spacing between said upper and lower plates.

8. The pulverizer of claim 1 including an annular primary airflow deflector disposed in said mill housing adjacent to and extending around said annular throat.

9. The pulverizer of claim 8 wherein said primary airflow deflector is angled inward over said annular throat toward said grinding surface for directing said primary airflow from said lower housing portion toward said grinding surface.

10. The pulverizer of claim 8 wherein a distal edge of said primary airflow deflector is connected to a distal edge of said secondary airflow deflector so there are no gaps between said primary airflow deflector and said secondary airflow deflector.

11. The pulverizer of claim 1 including a bypass conduit channeling a portion of said primary airflow into said secondary airflow chamber for providing said secondary airflow.

12. The pulverizer of claim 11 including an airflow valve operatively associated with said bypass conduit for controlling the flow of air through said bypass conduit to alter differential pressures between said upper housing portion and said lower housing portion and maintain desired air/fuel ratios.

13. A coal pulverizer having a grinding surface operatively associated with a grinding wheel being disposed in a mill housing for pulverizing coal chunks, said pulverizer comprising:

an annular throat disposed around said grinding surface channeling a primary airflow from a lower housing portion below said grinding surface upward through an upper housing portion above said grinding surface; and, an annular secondary airflow deflector extending along an interior of said upper housing portion above said grinding surface directing a secondary airflow received into said upper housing portion downward across said grinding surface in a uniform uninterrupted circumferential airflow pattern.

14. The pulverizer of claim 13 including an annular secondary airflow chamber extending around an exterior of said upper housing portion channeling a secondary airflow circumferentially into said annular secondary airflow deflector.

15. The pulverizer of claim 14 wherein said secondary airflow deflector includes an annular upper plate extending along said interior of said upper housing portion, and an annular lower plate extending along said interior of said upper housing portion.

16. The pulverizer of claim 15 wherein a lateral spacing of said upper plate from said lower plate defines an annular deflector channel in fluid communication with said secondary airflow chamber channeling said secondary airflow circumferentially into said upper housing portion.

17. The pulverizer of claim 13 including an annular primary airflow deflector disposed in said mill housing adjacent to and extending around said annular throat.

18. The pulverizer of claim 17 wherein said primary airflow deflector is angled inward over said annular throat toward said grinding surface for directing said primary airflow from said lower housing portion toward said grinding surface.

19. The pulverizer of claim 17 wherein a distal edge of said primary airflow deflector is connected to a distal edge of said secondary airflow deflector so there are no gaps between said primary airflow deflector and said secondary airflow deflector.

* * * * *